US008640481B2

(12) United States Patent
An

(10) Patent No.: US 8,640,481 B2
(45) Date of Patent: Feb. 4, 2014

(54) REFRIGERATOR HAVING WATER FEED SYSTEM

(75) Inventor: Jae Koog An, Seo-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 332 days.

(21) Appl. No.: 13/067,196

(22) Filed: May 16, 2011

(65) Prior Publication Data

US 2012/0006046 A1 Jan. 12, 2012

(30) Foreign Application Priority Data

Jul. 12, 2010 (KR) ..... 10-2010-0067040

(51) Int. Cl.
*F25D 23/12* (2006.01)

(52) U.S. Cl.
USPC ..... 62/338; 62/389

(58) Field of Classification Search
USPC ..... 62/318, 338, 389, 66, 67, 340; 222/146.6
See application file for complete search history.

(56) References Cited

U.S. PATENT DOCUMENTS

| | | | | |
|---|---|---|---|---|
| 4,793,835 | A * | 12/1988 | Rylander | 95/196 |
| 4,859,320 | A * | 8/1989 | Beall, Jr. | 210/136 |
| 7,216,502 | B2 * | 5/2007 | Jeong et al. | 62/318 |
| 7,603,869 | B2 * | 10/2009 | Kim et al. | 62/129 |
| 7,707,858 | B2 * | 5/2010 | Jeon et al. | 68/3 R |

* cited by examiner

*Primary Examiner* — Mohammad M Ali
(74) *Attorney, Agent, or Firm* — Staas & Halsey LLP

(57) ABSTRACT

A water feed system usable with a refrigerator having an icemaker and a dispenser, which assures efficient utilization of a storage space. The refrigerator includes a filter to purify water to be fed from an external water source to the icemaker and the dispenser, a water tank in which the water, purified by the filter, is stored so as to be cooled by interior cold air of the refrigerating compartment, and a valve provided at a junction of a hose connecting the filter to the water tank and the icemaker to selectively supply the water, purified by the filter, to the water tank or the icemaker. The filter, the water tank and the valve are received in a case so as to be integrally positioned in the refrigerating compartment.

8 Claims, 7 Drawing Sheets

REFRIGERATOR HAVING WATER FEED SYSTEM

CROSS-REFERENCE TO RELATED APPLICATIONS

This application claims the benefit of Korean Patent Application No. 2010-0067040, filed on Jul. 12, 2010 in the Korean Intellectual Property Office, the disclosure of which is incorporated herein by reference.

BACKGROUND

1. Field

Embodiments relate to a refrigerator and a water feed system usable with the refrigerator having an improved mounting structure for arrangement of a filter, water tank and valve.

2. Description of the Related Art

In general, a refrigerator is designed to keep food fresh at a low temperature by supplying low-temperature cold air into a storage compartment in which the food is stored.

A variety of large-volume refrigerators have been marketed to provide users with a more convenient lifestyle and a greater storage space. In particular, French door type refrigerators have been marketed, in which the interior of the refrigerator is divided into a freezing compartment and a refrigerating compartment by a horizontal partition, the refrigerating compartment is adapted to be opened or closed by double doors and the freezing compartment takes the form of a drawer to be drawn from a main body.

French door type refrigerators generally include an icemaker that makes ice inside a refrigerator main body and a dispenser that allows a user to dispense water from the front of a door without opening the door. This type of refrigerator further includes a water feed system to feed water to the icemaker or the dispenser.

The water feed system includes a filter, a water tank and a valve. Thus, the water feed system serves to purify water fed from an external water source and feed the purified water to the icemaker or the water tank under control of the valve provided at a junction of a hose connecting the filter to the icemaker and water tank.

In a conventional water feed system, generally, a filter, a water tank and a valve are arranged separately. In particular, the water tank is located in a refrigerating compartment, whereas the valve is located in a bottom machine room of the refrigerator, which results in an increased length and complicated configuration of a water feed pipe because the water feed pipe extends from the filter to the water tank and the icemaker by way of the valve.

In addition, separately mounting the filter, water tank and valve in a main body may entail an inconvenient assembly process.

SUMMARY

Therefore, it is an aspect to provide a water feed system for use in a French door type refrigerator having an icemaker and a dispenser, in which arrangement of a filter, water tank and valve and a configuration of a water feed pipe are simplified, resulting in improved workability and maximized utilization of the interior space of the refrigerator.

Additional aspects will be set forth in part in the description which follows and, in part, will be apparent from the description, or may be learned by practice of the invention.

In accordance with one aspect, a refrigerator, including a refrigerating compartment, an icemaker and a dispenser, further includes a filter to purify water to be fed from an external water source to the icemaker and the dispenser, a water tank in which the water, purified by the filter, is stored so as to be cooled by interior cold air of the refrigerating compartment, and a valve provided at a junction of a hose connecting the filter to the water tank and the icemaker to selectively supply the water, purified by the filter, to the water tank or the icemaker, wherein the filter, the water tank and the valve are received in a case so as to be integrally positioned in the refrigerating compartment.

The refrigerator may further include a plurality of drawer type storage containers horizontally arranged in parallel and adapted to be drawn from the refrigerating compartment, and the filter, the water tank and the valve may be received in the case so as to be integrally positioned between the plurality of drawer type storage containers.

The refrigerator may further include a drawer type storage container adapted to be drawn from the refrigerating compartment, and the filter, the water tank and the valve may be received in the case so as to be integrally positioned between the drawer type storage container and a sidewall of the refrigerator.

The refrigerator may further include a control valve provided on a hose connecting the external water source and the filter to each other and serving to control supply of water from the external water source, and the filter, the water tank, the valve and the control valve may be received in the case so as to be integrally positioned in the refrigerating compartment.

In accordance with another aspect, a refrigerator, including a refrigerating compartment, an icemaker and a dispenser, the refrigerator further includes a filter to purify water to be fed from an external water source to the icemaker and the dispenser, a water tank in which the water, purified by the filter, is stored so as to be cooled by interior cold air of the refrigerating compartment, and a valve provided at a junction of a hose connecting the water tank to the icemaker and the dispenser to selectively supply the water, stored in the water tank, to the icemaker or the dispenser, wherein the filter, the water tank and the valve are received in a case so as to be integrally positioned in the refrigerating compartment.

The refrigerator may further include a plurality of drawer type storage containers horizontally arranged in parallel and adapted to be drawn from the refrigerating compartment, and the filter, the water tank and the valve may be received in the case so as to be integrally positioned between the plurality of drawer type storage containers.

The refrigerator may further include a drawer type storage container adapted to be drawn from the refrigerating compartment, and the filter, the water tank and the valve may be received in the case so as to be integrally positioned between the drawer type storage container and a sidewall of the refrigerator.

The refrigerator may further include a control valve provided on a hose connecting the external water source and the filter to each other and serving to control supply of water from the external water source, and the filter, the water tank, the valve and the control valve may be received in the case so as to be integrally positioned in the refrigerating compartment.

In accordance with another aspect, a water feed system of a refrigerator, used to feed water to an icemaker installed in a refrigerating compartment and a dispenser installed to a front surface of a door of the refrigerating compartment, includes a filter and water tank assembly, a first water feed pipe connecting an external water source and the filter and water tank assembly to each other, a second water feed pipe connecting the filter and water tank assembly and the icemaker to each other, and a third water feed pipe connecting the filter and water tank assembly and the dispenser to each other, wherein the filter and water tank assembly includes a filter connected to the first water feed pipe and serving to purify water fed from the external water source, a water tank in which the water, purified by the filter, is cooled and stored, the water tank being connected to the third water feed pipe, and a valve provided at a junction of a hose connecting the filter to the water tank and the second water feed pipe to selectively supply the water from the filter to the water tank or the second water feed pipe, and wherein the filter and water tank assembly is positioned within the refrigerating compartment of the refrigerator.

The refrigerating compartment may include a plurality of drawer type storage containers horizontally arranged in parallel and adapted to be drawn from the refrigerating compartment, and the filter and water tank assembly may be positioned between the plurality of drawer type storage containers.

The refrigerating compartment may further include a drawer type storage container adapted to be drawn from the refrigerating compartment, and the filter and water tank assembly may be positioned between the drawer type storage container and a sidewall of the refrigerator.

The filter and water tank assembly may further include a control valve provided on a hose connecting the first water feed pipe and the filter to each other and serving to control supply of water from the external water source.

In accordance with a further aspect, a water feed system of a refrigerator, used to feed water to an icemaker installed in a refrigerating compartment and a dispenser installed to a front surface of a door of the refrigerating compartment, includes a filter and water tank assembly, a first water feed pipe connecting an external water source and the filter and water tank assembly to each other, a second water feed pipe connecting the filter and water tank assembly and the icemaker to each other, and a third water feed pipe connecting the filter and water tank assembly and the dispenser to each other, wherein the filter and water tank assembly includes a filter connected to the first water feed pipe and serving to purify water fed from the external water source, a water tank in which the water, purified by the filter, is cooled and stored, and a valve provided at a junction of a hose connecting the water tank to the second water feed pipe and the third water feed pipe to selectively supply the water from the water tank to the second water feed pipe or the third water feed pipe, and wherein the filter and water tank assembly is positioned within the refrigerating compartment of the refrigerator.

The refrigerating compartment may include a plurality of drawer type storage containers horizontally arranged in parallel and adapted to be drawn from the refrigerating compartment, and the filter and water tank assembly may be positioned between the plurality of drawer type storage containers.

The refrigerating compartment may include a drawer type storage container adapted to be drawn from the refrigerating compartment, and the filter and water tank assembly may be positioned between the drawer type storage container and a sidewall of the refrigerator.

The filter and water tank assembly may further include a control valve provided on a hose connecting the first water feed pipe and the filter to each other and serving to control supply of water from the external water source.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
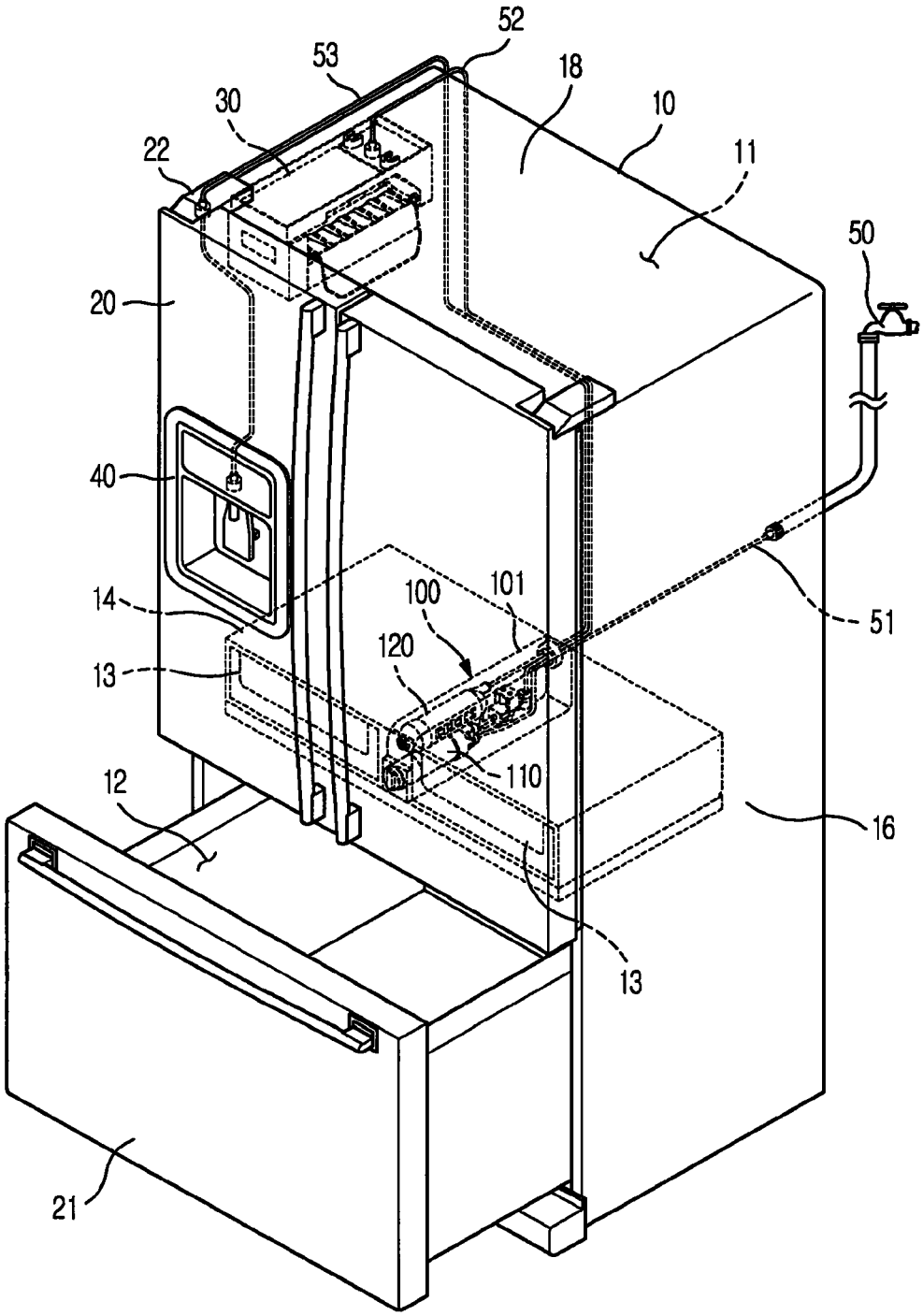
FIG. 1 is a perspective view illustrating a refrigerator according to one embodiment.

Reference will now be made in detail to the embodiments, examples of which are illustrated in the accompanying drawings, wherein like reference numerals refer to like elements throughout.

Figure 2:
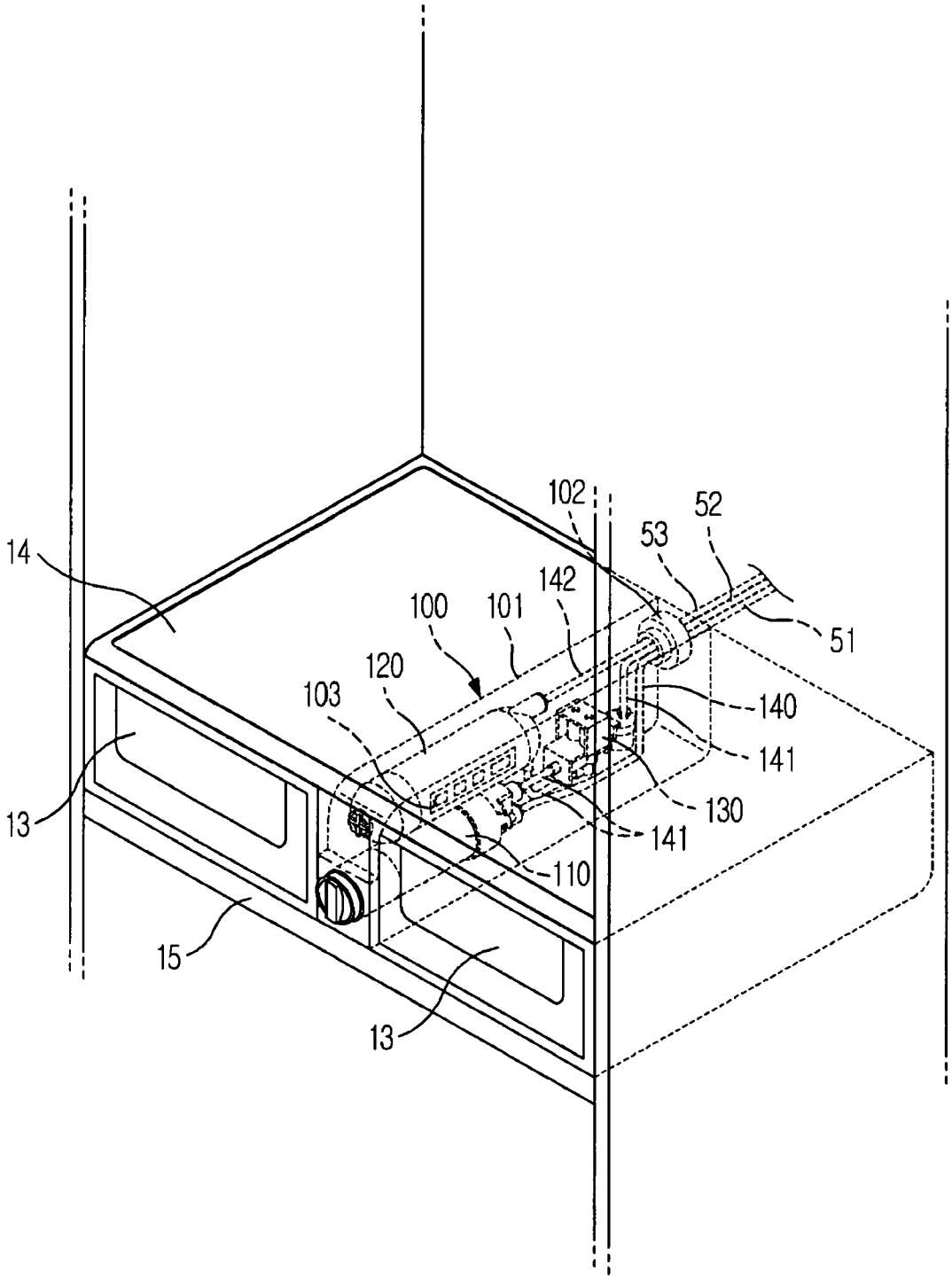
FIG. 2 is an enlarged view schematically an arrangement of a filter and water tank assembly provided in the refrigerator of FIG. 1.
Figure 3:
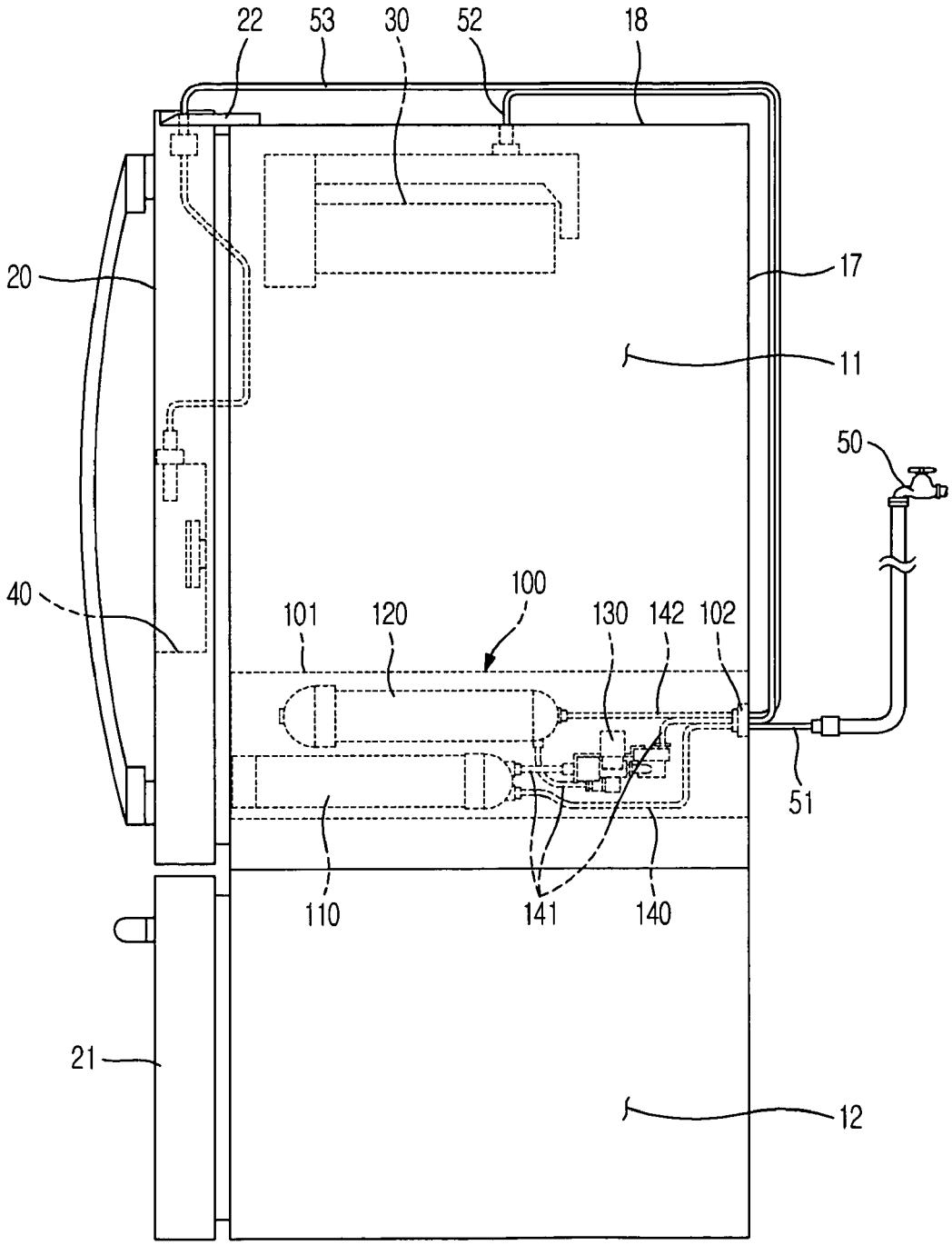
FIG. 3 is a schematic side sectional view of the refrigerator of FIG. 1.

FIG. 1 is a perspective view illustrating a refrigerator according to one embodiment, FIG. 2 is an enlarged view schematically an arrangement of a filter and water tank assembly provided in the refrigerator of FIG. 1, and FIG. 3 is a schematic side sectional view of the refrigerator of FIG. 1.

As illustrated in FIGS. 1 to 3, the refrigerator according to the embodiment is of a French door type and includes a main body 10 and storage compartments 11 and 12. The storage compartments 11 and 12 are divided, by a horizontal partition 15, into an upper refrigerating compartment 11 for storage of refrigerated food and a lower freezing compartment 12 for storage of frozen food.

The refrigerating compartment 11 has an open front side to be opened or closed by double doors 20 hinged to opposite lateral sides thereof. The freezing compartment 12 is defined in a drawer 21 having an open upper side. The drawer 21 is adapted to be drawn from the main body 10 and the open upper side of the drawer 21 is closed by the horizontal partition 15 when the drawer 21 is pushed into the main body 10 via sliding thereof.

The refrigerating compartment 11 contains a drawer type storage container 13 seated on the horizontal partition 15. The storage container 13 serves to store food sensitive to dehydration, such as vegetables, etc.

The drawer type storage container 13 has an open upper side for entrance/exit of food. The drawer type storage container 13 is adapted to be drawn from the refrigerating compartment 11 and the open upper side of the drawer type storage container 13 is closed by a drawer type storage container cover 14 when the drawer type storage container 13 is pushed into the refrigerating compartment 11 via sliding thereof.

An icemaker 30 is mounted in an upper lateral region of the refrigerating compartment 11 partitioned by an insulating wall. Also, a dispenser 40 is provided at one of the doors 20 to allow a user to dispense water or ice from the outside of the main body 10 without opening the door 20.

The refrigerator further includes a water feed system to feed water to the icemaker 30 and the dispenser 40. The water feed system includes a filter and water tank assembly 100, a first water feed pipe 51 to connect the filter and water tank assembly 100 and an external water source 50 to each other, a second water feed pipe 52 to connect the filter and water tank assembly 100 and the icemaker 30 to each other, and a third water feed pipe 53 to connect the filter and water tank assembly 100 and the dispenser 40 to each other.

The filter and water tank assembly 100 is arranged in the refrigerating compartment 11. The filter and water tank assembly 100 includes a filter 110 to purify water fed from the exterior water source 50, a water tank 120 to cool the purified water from the filter 110 using interior cold air of the refrigerating compartment 11, a valve 130 provided at a junction of a hose 141 connecting the filter 110 to the water tank 120 and the icemaker 30, and a case 101 enclosing the aforementioned components.

The filter and water tank assembly 110 further includes hoses 140, 141 and 142 connecting the filter 110, water tank 120 and valve 130 to one another. The case 101 is provided at a location thereof with a hole 102 through which the hoses 140, 141 and 142 may be connected to the water feed pipes 51, 52 and 53.

Alternatively, the hoses 140, 141 and 142 may be extended to replace the water feed pipes 51, 52 and 53.

The filter 110 and the external water source 50 are connected to each other via the hose 140 and the first water feed pipe 51. The water tank 120 and the dispenser 40 are connected to each other via the hose 142 and the third water feed pipe 53. Also, the filter 110, water tank 120 and icemaker 30 are connected to one another via the hose 141 and the second water feed pipe 52.

The valve 130 is mounted at a junction of the hose 141 and serves to control supply of water from the filter 110 to the water tank 120 or the icemaker 30.

The water, purified by the filter 110, may directly be fed to the icemaker 30 through the hose 141 and the second water feed pipe 52. Alternatively, the purified water may first be fed to the water tank 120 through the hose 141 so as to be cooled and stored in the water tank 120 and thereafter, be fed to the dispenser 40 through the hose 142 and the third water feed pipe 53 according to user manipulation.

With the above-described configuration of the filter and water tank assembly 100, the water feed system may need a significantly reduced number of water feed pipes, i.e. only three water feed pipes including the first, second and third water feed pipes 51, 52 and 53.

One end of each of the first, second and third water feed pipes 51, 52 and 53 is connected respectively to the external water source 50, icemaker 30 and dispenser 40. Thus, the filter 110, water tank 120 and valve 130 of the filter and water tank assembly 100 may be connected to the external water source 50, icemaker 30 and dispenser 40 by simply connecting the other end of each of the first, second and third water feed pipes 51, 52 and 53 to the respective hoses 140, 141 and 142.

The water feed pipes 51, 52 and 53 respectively penetrate only one location of a rear wall 17, upper wall 18 and door hinge 22 of the refrigerator main body 10.

This configuration may assure easy mounting and remarkably improved workability of the water feed system.

In addition, by simply putting the previously-fabricated filter and water tank assembly 100 into the main body 10 and connecting it to the water feed pipes 51, 52 and 53, the water feed system may assure very convenient mounting and remarkably reduced possibility of incorrect assembly thereof.

More specifically, the filter and water tank assembly 100 is located between a plurality of drawer type storage containers 13 horizontally arranged in parallel in a lower region of the refrigerating compartment 11.

With this arrangement of the filter and water tank assembly 100, the filter and water tank assembly 100 naturally serves as a vertical partition between the neighboring drawer type storage containers 13.

In other words, as the filter and water tank assembly 100 is arranged in a region that was previously useless between the drawer type storage containers 13 within the refrigerating compartment 11, the water feed system may be mounted without encroaching upon an effective interior storage space of the refrigerating compartment 11.

If LED lamps 103 are attached to opposite lateral surfaces of the case 101, it may allow a space used for installation of LED lamps in a conventional refrigerator to be utilized as a storage space and may eliminate the need for a separate operation to mount the LED lamps 103 inside the refrigerating compartment 11, resulting in convenience in the manufacture of the refrigerator.

Figure 4:
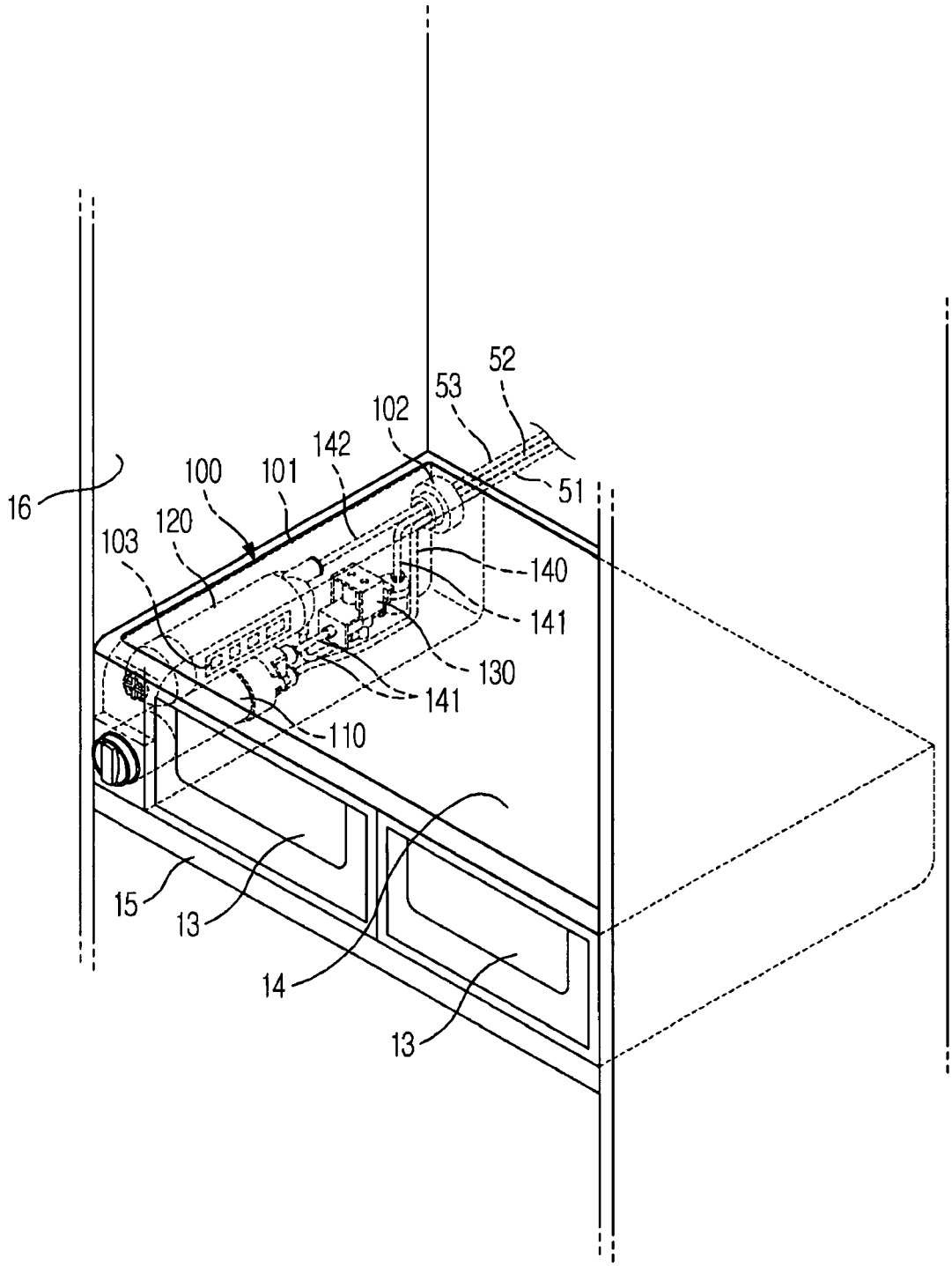
FIG. 4 is an enlarged view illustrating an arrangement of a filter and water tank assembly provided in a refrigerator according to another embodiment.

FIG. 4 is an enlarged view illustrating an arrangement of a filter and water tank assembly provided in a refrigerator according to another embodiment.

Referring to FIG. 4, the refrigerator according to the present embodiment has substantially the same configuration as that of the previously described embodiment illustrated in FIGS. 1 to 3 except that the filter and water tank assembly 100 is provided between the drawer type storage container 13 and a sidewall 16 of the refrigerator.

The embodiments have a feature in that the filter 110, water tank 120 and valve 130 are integrated with one another and are placed in a region of the refrigerating compartment 11 that was previously useless, thus realizing a simplified water feed configuration and enhanced space utilization of the refrigerator. Accordingly, it will be appreciated that the filter and water tank assembly 100 may be placed at other appropriate locations within the refrigerating compartment 11 as well as between the drawer type storage containers 13 as described in the firstly described embodiment or between the drawer type storage container 13 and the sidewall 16 of the refrigerator as described in the secondly described embodiment.

Figure 5:
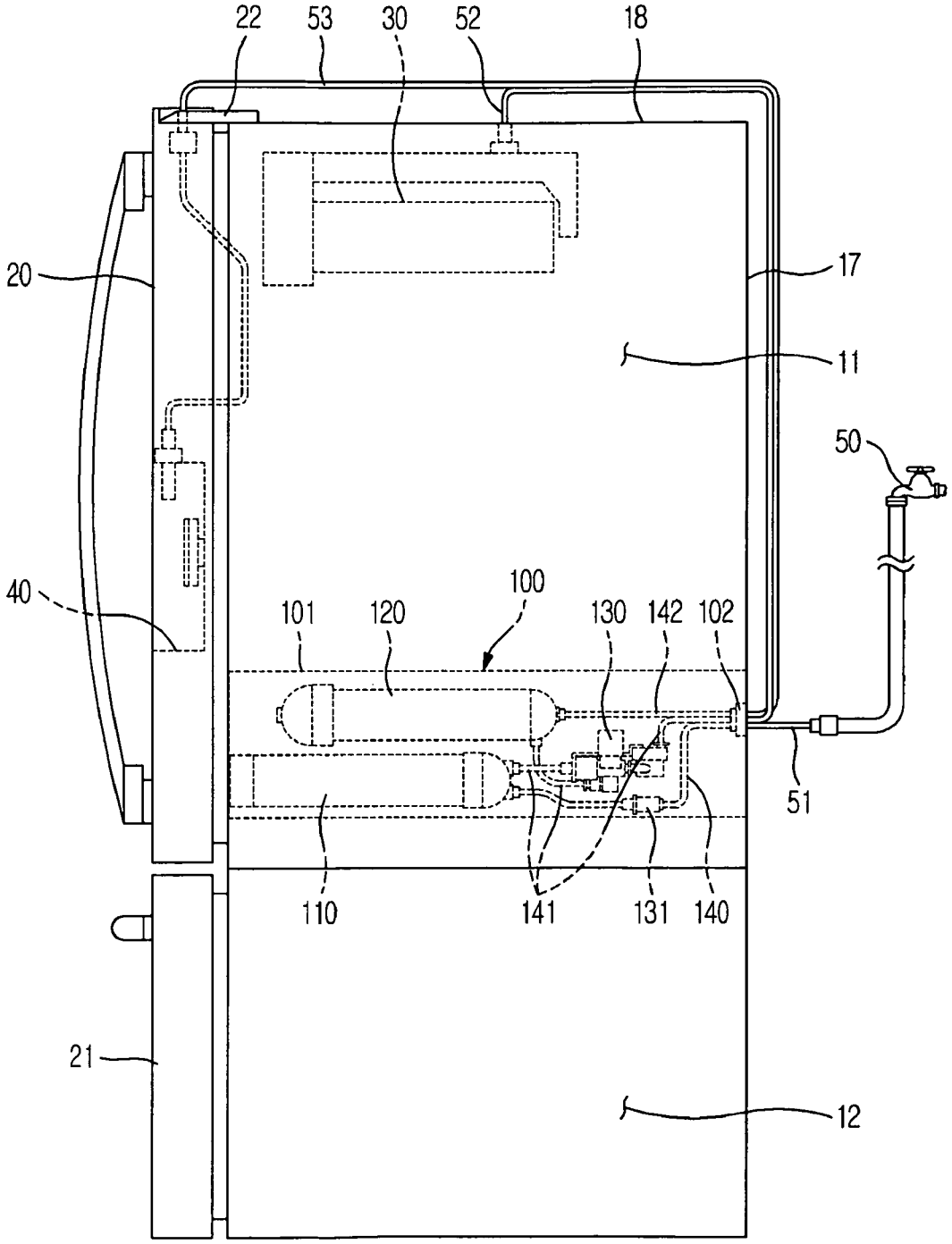
FIG. 5 is a schematic side sectional view of a refrigerator according to another embodiment.

FIG. 5 is a schematic side sectional view of a refrigerator according to another embodiment.

Referring to FIG. 5, the refrigerator may have substantially the same configuration as those of the previously described embodiments illustrated in FIGS. 1 to 4 except that the filter and water tank assembly 100 further includes a control valve 131 mounted on the hose 140 connecting the external water source 50 and the filter 100 to each other.

In the refrigerator illustrated in FIG. 5, the filter and water tank assembly 100 is provided with the control valve 131 to control supply of water from the external water source 50. This may effectively deal with leakage of water due to damage to the filter 100 caused to the filter 110 upon continuous exposure to water pressure.

For example, if the filter 110 is damaged or a part of the water feed system malfunctions, the control valve 131 intercepts supply of water from the external water source 50, preventing water from leaking into the main body 10.

This results in a remarkable increase in the reliability of the refrigerator.

Figure 6:
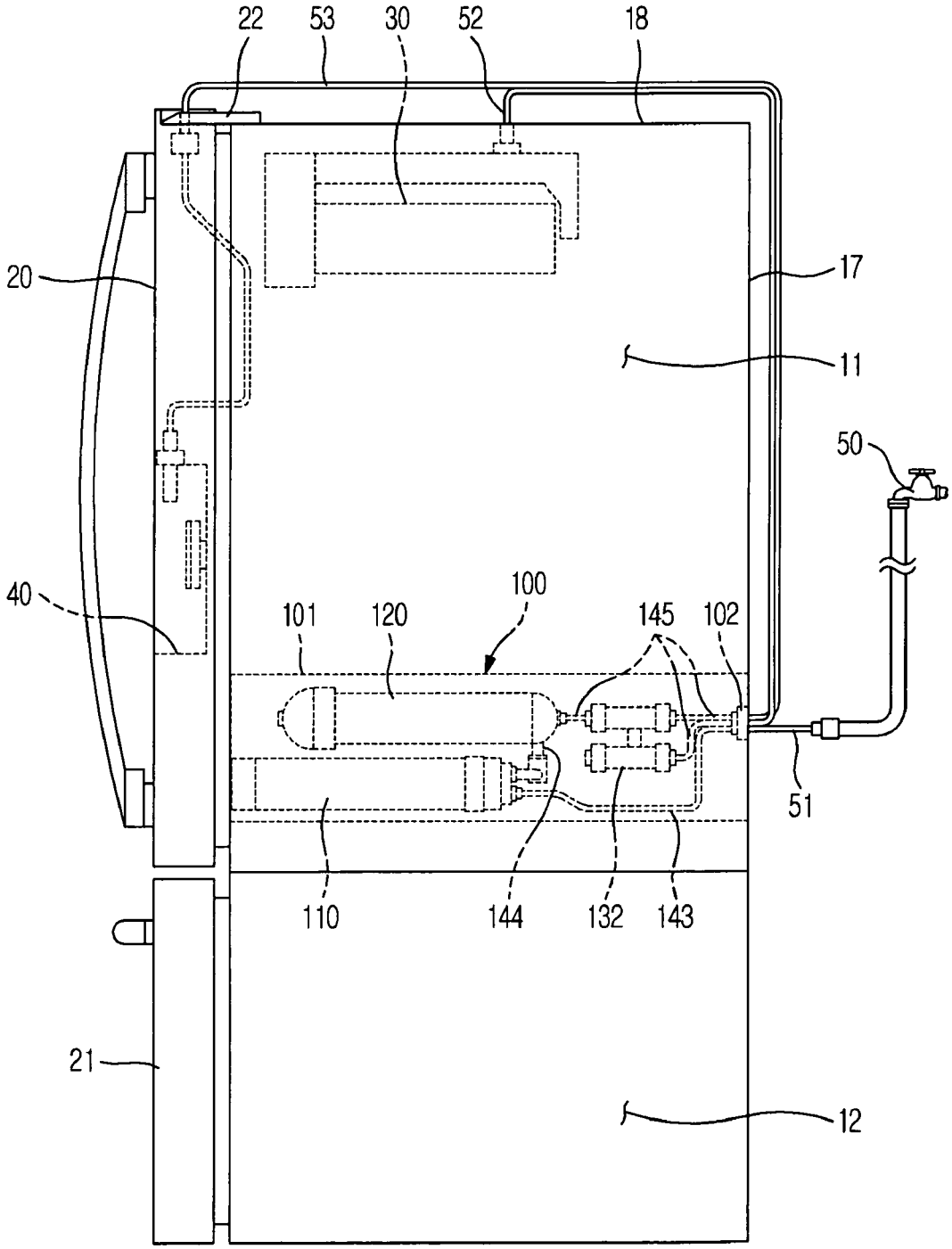
FIG. 6 is a schematic side sectional view of a refrigerator according to another embodiment.

FIG. 6 is a schematic side sectional view of a refrigerator according to another embodiment.

Referring to FIG. 6, the refrigerator may have substantially the same configuration as those of the previously described embodiments illustrated in FIGS. 1 to 4 except for an internal connection of the filter and water tank assembly 100.

In the refrigerator illustrated in FIG. 6, differently from the previously described embodiments, the filter 110 is connected to the water tank 120 via a hose 144.

In addition, the water tank 120 is connected to the icemaker 30 and dispenser 40 via a hose 145, and a valve 132 is mounted at a junction of the hose 145 so as to control supply of water from the water tank 120 to the icemaker 30 or the dispenser 40.

In the refrigerator illustrated in FIG. 6, differently from the previously described embodiments, water, which has been cooled to an appropriate temperature in the water tank 120, is fed to the icemaker 30.

As a result of feeding appropriately cooled water to the icemaker 30, the refrigerator illustrated in FIG. 6 may more effectively make ice via the icemaker 30.

Figure 7:
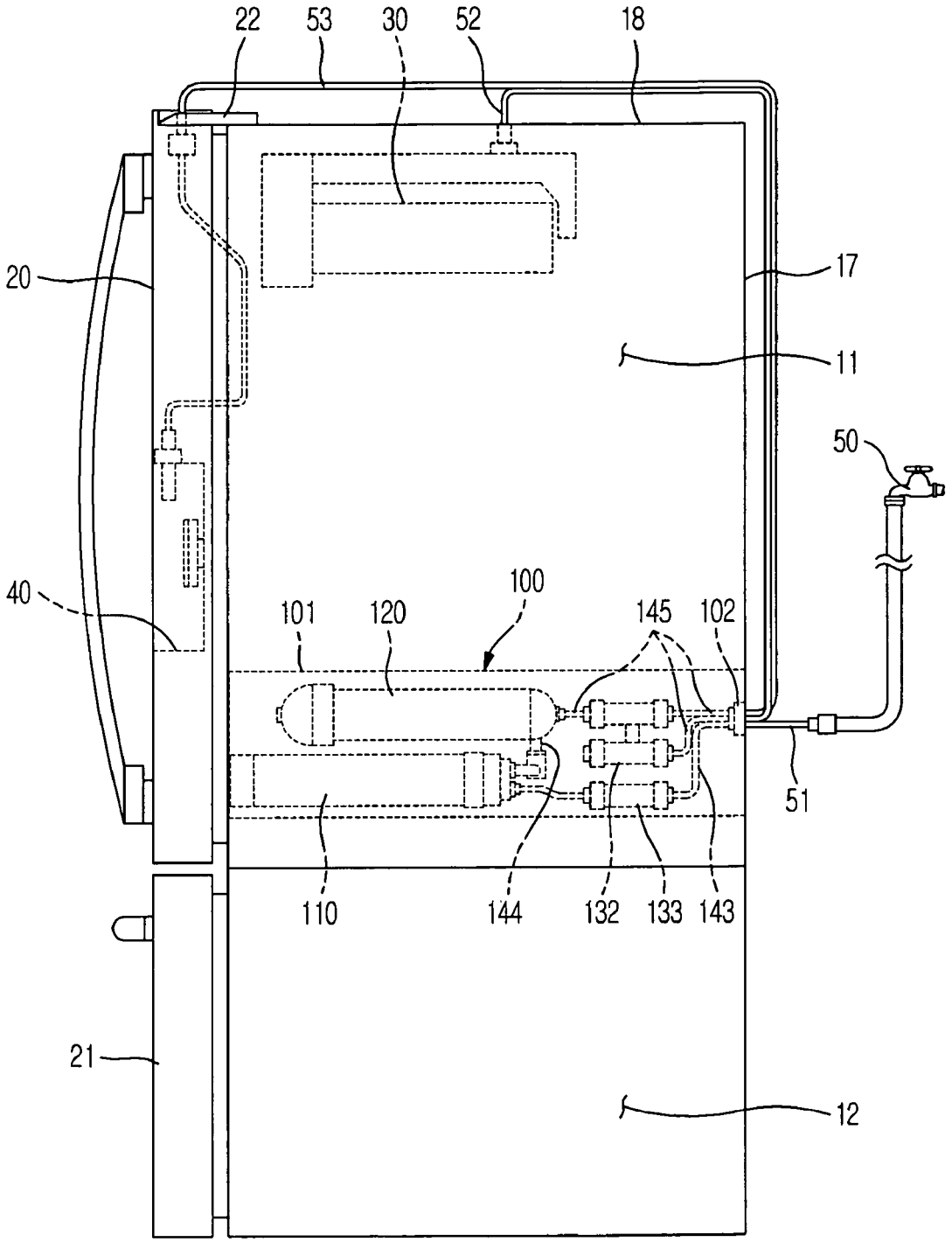
FIG. 7 is a schematic side sectional view of a refrigerator according to a further embodiment.

FIG. 7 is a schematic side sectional view of a refrigerator according to a further embodiment.

Referring to FIG. 7, the refrigerator may have substantially the same configuration as that of the previously described embodiment illustrated in FIG. 6 except that the filter and water tank assembly 100 further includes a control valve 133 mounted on the hose 143 connecting the external water source 50 and the filter 110 to each other.

Thus, similar to the refrigerator illustrated in FIG. 5, the refrigerator illustrated in FIG. 7 may intercept supply of water from the external water source 50 using the control valve 133 when the filter 110 is damaged or a part of the water feed system malfunctions, thereby preventing the water from leaking into the main body 10.

As is apparent from the above description, a water feed system usable with a refrigerator according to the embodiments, which serves to purify and cool water to an appropriate temperature and feed the water to a dispenser and an icemaker, may have a simplified configuration, thereby assuring easy mounting thereof and increasing the space utilization of the refrigerator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A water feed system of a refrigerator, used to feed water to an icemaker installed in a refrigerating compartment and a dispenser installed to a front surface of a door of the refrigerating compartment, comprising:

a filter and water tank assembly;

a first water feed pipe connecting an external water source and the filter and water tank assembly to each other;

a second water feed pipe connecting the filter and water tank assembly and the icemaker to each other; and a third water feed pipe connecting the filter and water tank assembly and the dispenser to each other, wherein the filter and water tank assembly includes:

a filter connected to the first water feed pipe and serving to purify water fed from the external water source;

a water tank in which the water, purified by the filter, is cooled and stored, the water tank being connected to the third water feed pipe; and a valve provided at a junction of a hose connecting the filter to the water tank and the second water feed pipe to selectively supply the water from the filter to the water tank or the second water feed pipe, and wherein the filter and water tank assembly is positioned within the refrigerating compartment of the refrigerator.

2. The water feed system according to claim 1, wherein:

the refrigerating compartment includes a plurality of drawer type storage containers horizontally arranged in parallel and adapted to be drawn from the refrigerating compartment; and the filter and water tank assembly is positioned between the plurality of drawer type storage containers.

3. The water feed system according to claim 1, wherein:

the refrigerating compartment includes a drawer type storage container adapted to be drawn from the refrigerating compartment; and the filter and water tank assembly is positioned between the drawer type storage container and a sidewall of the refrigerator.

4. The water feed system according to claim 1, wherein the filter and water tank assembly further includes a control valve provided on a hose connecting the first water feed pipe and the filter to each other and serving to control supply of water from the external water source.

5. A water feed system of a refrigerator, used to feed water to an icemaker installed in a refrigerating compartment and a dispenser installed to a front surface of a door of the refrigerating compartment, comprising:

a filter and water tank assembly;

a first water feed pipe connecting an external water source and the filter and water tank assembly to each other;

a second water feed pipe connecting the filter and water tank assembly and the icemaker to each other; and a third water feed pipe connecting the filter and water tank assembly and the dispenser to each other, wherein the filter and water tank assembly includes:

a filter connected to the first water feed pipe and serving to purify water fed from the external water source;

a water tank in which the water, purified by the filter, is cooled and stored; and a valve provided at a junction of a hose connecting the water tank to the second water feed pipe and the third water feed pipe to selectively supply the water from the water tank to the second water feed pipe or the third water feed pipe, and wherein the filter and water tank assembly is positioned within the refrigerating compartment of the refrigerator.

6. The water feed system according to claim 5, wherein:

the refrigerating compartment includes a plurality of drawer type storage containers horizontally arranged in parallel and adapted to be drawn from the refrigerating compartment; and the filter and water tank assembly is positioned between the plurality of drawer type storage containers.

7. The water feed system according to claim 5, wherein:

the refrigerating compartment includes a drawer type storage container adapted to be drawn from the refrigerating compartment; and the filter and water tank assembly is positioned between the drawer type storage container and a sidewall of the refrigerator.

8. The water feed system according to claim 5, wherein the filter and water tank assembly further includes a control valve provided on a hose connecting the first water feed pipe and the filter to each other and serving to control supply of water from the external water source.

* * * * *